US008272342B1

(12) United States Patent
Manuel, Jr.

(10) Patent No.: US 8,272,342 B1
(45) Date of Patent: Sep. 25, 2012

(54) COUNTERWEIGHTED MOORING LINE

(76) Inventor: John Lester Manuel, Jr., Wichita, KS (US)

( * ) Notice: Subject to any disclaimer, the term of this patent is extended or adjusted under 35 U.S.C. 154(b) by 188 days.

(21) Appl. No.: 12/589,324

(22) Filed: Oct. 22, 2009

Related U.S. Application Data

(60) Provisional application No. 61/196,980, filed on Oct. 22, 2008.

(51) Int. Cl.
*B63B 21/00* (2006.01)

(52) U.S. Cl. ..... 114/230.25

(58) Field of Classification Search ..... 114/221 R, 114/223, 230.26, 230.28, 230.29, 230.2, 114/297, 298, 299, 230.25; 89/1.34; 294/86.4, 294/87.1, 82.1, 82.11, 82.12; 43/5, 43.1, 43/43.12, 43.16, 44.93
See application file for complete search history.

(56) References Cited

U.S. PATENT DOCUMENTS

| | | | | | |
|---|---|---|---|---|---|
| 275,197 | A | * | 4/1883 | Griffin | 182/50 |
| 653,021 | A | * | 7/1900 | Hamilton | 114/230.26 |
| 1,509,012 | A | * | 9/1924 | Whiting | 114/215 |
| 1,858,941 | A | * | 5/1932 | Salmon | 294/66.1 |
| 1,982,132 | A | * | 11/1934 | Boles | 43/5 |
| 2,166,575 | A | * | 7/1939 | Atcherley | 244/135 A |
| 2,330,470 | A | * | 9/1943 | Calahan | 206/573 |
| 2,334,979 | A | * | 11/1943 | Adams | 258/1.6 |
| 2,652,957 | A | * | 9/1953 | Wolf | 223/92 |
| 2,676,430 | A | * | 4/1954 | Richard | 43/17.2 |
| 2,894,351 | A | * | 7/1959 | Doane | 43/44.6 |
| 3,097,373 | A | * | 7/1963 | Wisti | 441/85 |
| 3,103,199 | A | * | 9/1963 | Gagnon | 114/221 R |
| 3,336,067 | A | * | 8/1967 | Cloyd | 294/66.1 |
| 3,473,505 | A | * | 10/1969 | Brown | 114/230.29 |
| 3,598,079 | A | * | 8/1971 | Cudley | 114/153 |
| 3,599,592 | A | * | 8/1971 | Welton | 114/230.28 |
| 3,664,054 | A | * | 5/1972 | Pickering | 43/19 |
| 3,815,274 | A | * | 6/1974 | Schleif | 43/42.1 |
| 3,878,808 | A | * | 4/1975 | Mock, Jr. | 114/230.25 |
| 4,008,587 | A | * | 2/1977 | Frentzel et al. | 70/235 |
| 4,073,255 | A | * | 2/1978 | Paul | 114/230.25 |
| 4,095,548 | A | * | 6/1978 | Bruner | 114/230.29 |
| 4,145,835 | A | * | 3/1979 | Snow | 43/96 |
| 4,173,194 | A | * | 11/1979 | McLaughlin | 114/218 |
| 4,261,280 | A | * | 4/1981 | Collic, Sr. | 114/221 R |
| 4,401,327 | A | * | 8/1983 | Caines | 289/1.2 |
| 4,462,329 | A | * | 7/1984 | Brushaber | 114/230.25 |
| 4,595,223 | A | * | 6/1986 | Hawie | 294/175 |
| 4,655,158 | A | * | 4/1987 | Holder | 114/297 |
| 4,661,077 | A | * | 4/1987 | Griffith et al. | 441/84 |
| 4,686,325 | A | | 8/1987 | Marsico et al. | |
| 4,713,033 | A | * | 12/1987 | Cameron | 441/84 |
| 4,751,892 | A | * | 6/1988 | Sechel et al. | 114/221 R |
| 4,785,509 | A | * | 11/1988 | Fisher | 294/82.1 |
| 4,848,261 | A | * | 7/1989 | Kobayashi | 114/299 |
| 5,009,181 | A | * | 4/1991 | Upchurch | 114/230.25 |
| 5,074,235 | A | * | 12/1991 | Kobayashi | 114/299 |
| 5,381,749 | A | * | 1/1995 | Larson | 114/221 R |
| 5,520,134 | A | * | 5/1996 | Walker | 114/230.25 |

(Continued)

*Primary Examiner* — Lars A Olson
*Assistant Examiner* — Andrew Polay

(57) ABSTRACT

A counterweighted mooring line includes a line, a counterweight portion and a hook. The line has a proximal end which is secured to a watercraft and an opposite distal end. The hook is tied to the distal end of the line and includes a center shaft with an opening for receiving the line and at least one prong extending from a center shaft. The counterweight portion is also secured to the line and is spaced away from the grappling hook. The counterweight portion and hook may be thrown at a pole to catch the pole or dragged across a float having cleats in order to catch a cleat.

13 Claims, 5 Drawing Sheets

U.S. PATENT DOCUMENTS 5,555,669 A * 9/1996 Fitzgerald ..... 43/44.96
5,676,084 A * 10/1997 Palmer et al. ..... 114/230.2
5,704,669 A * 1/1998 Clark ..... 294/209
5,785,146 A * 7/1998 Palmer ..... 182/3
5,799,602 A * 9/1998 Trillo ..... 114/221 R
6,053,156 A 4/2000 Boon
6,209,475 B1 * 4/2001 Powell ..... 114/299
6,267,424 B1 * 7/2001 Gillette ..... 294/82.1
6,273,645 B1 8/2001 Hamre
6,591,560 B2 * 7/2003 Burke et al. ..... 52/177
6,644,409 B1 * 11/2003 Strømberg et al. ..... 166/349
6,659,823 B1 * 12/2003 Mosna et al. ..... 441/84
6,948,751 B2 * 9/2005 Wooten et al. ..... 294/82.1
6,951,182 B2 * 10/2005 Onweller ..... 114/221 R
7,029,047 B2 * 4/2006 Wooten et al. ..... 294/82.1
7,029,353 B2 * 4/2006 Goodman et al. ..... 441/84
7,032,529 B2 4/2006 Sanford
7,086,344 B2 * 8/2006 Onweller ..... 114/221 R
7,117,629 B2 * 10/2006 Brzozowski ..... 43/43.15
7,240,937 B2 * 7/2007 Wooten et al. ..... 294/82.1
7,340,858 B2 * 3/2008 Corbitt ..... 43/44.96
2003/0116074 A1 * 6/2003 Williams ..... 114/221 R
2004/0202805 A1 * 10/2004 Chroman ..... 428/34.1
2004/0248483 A1 * 12/2004 Bolta ..... 441/80
2005/0009423 A1 * 1/2005 Goodman et al. ..... 441/84
2005/0022711 A1 * 2/2005 Onweller ..... 114/221 R
2005/0061223 A1 * 3/2005 Carr ..... 114/230.2
2006/0168875 A1 * 8/2006 Brzozowski ..... 43/44.9
2006/0237979 A1 * 10/2006 Wooten et al. ..... 294/82.1
2007/0170737 A1 * 7/2007 Wooten et al. ..... 294/82.1
2008/0245287 A1 * 10/2008 Vogan et al. ..... 114/293

* cited by examiner

COUNTERWEIGHTED MOORING LINE

FIELD OF THE INVENTION

This invention relates to a counterweighted mooring line for securing a watercraft to a float or pier.

BACKGROUND OF THE INVENTION

Previous mooring lines for securing a watercraft to a float or pier have typically consisted of a line which is tossed to a person on shore who assists in mooring the watercraft. A watercraft deckhand typically tosses a mooring line toward a person standing on a float who then secures the line to a cleat or a post. A deckhand may also employ a loop at the end of the rope in an attempt to catch a post or a cleat. When no on-shore assistance is available, the task of securing a line to a post or cleat can be very difficult or even dangerous. Where there is no on-shore assistance, a pilot or deckhand may step from the watercraft to the float in order to tie a line to a pole or cleat. Then, the pilot or deckhand will step back onto the watercraft to complete the mooring process. In most conditions this is an inconvenience. In some conditions, the prior art process of mooring a boat can be dangerous. And, this is particularly true when there is no on-shore assistance available. What is needed is an improved mooring line which facilitates the action of catching a cleat or post.

BRIEF DESCRIPTION

The aforementioned need is addressed by a counterweighted mooring line. The counterweighted mooring line includes a line, a counterweight portion and a hook. The line has a proximal end which is secured to a watercraft and an opposite distal end. The hook is tied to the distal end of the line and includes a center shaft having a proximal end and a distal end. An opening at the proximal end of the shaft ties to the distal end of the line. At least one prong extends from the distal end of the center shaft. The counterweight portion is spaced away from the hook and is secured to the line. A pilot or deckhand may toss the counterweight portion and the hook in unison from opposite hands toward a pole to catch a pole or may be thrown and dragged across a float in order to catch a cleat secured to a float.

DETAILED DESCRIPTION

Figures 1, 1C:
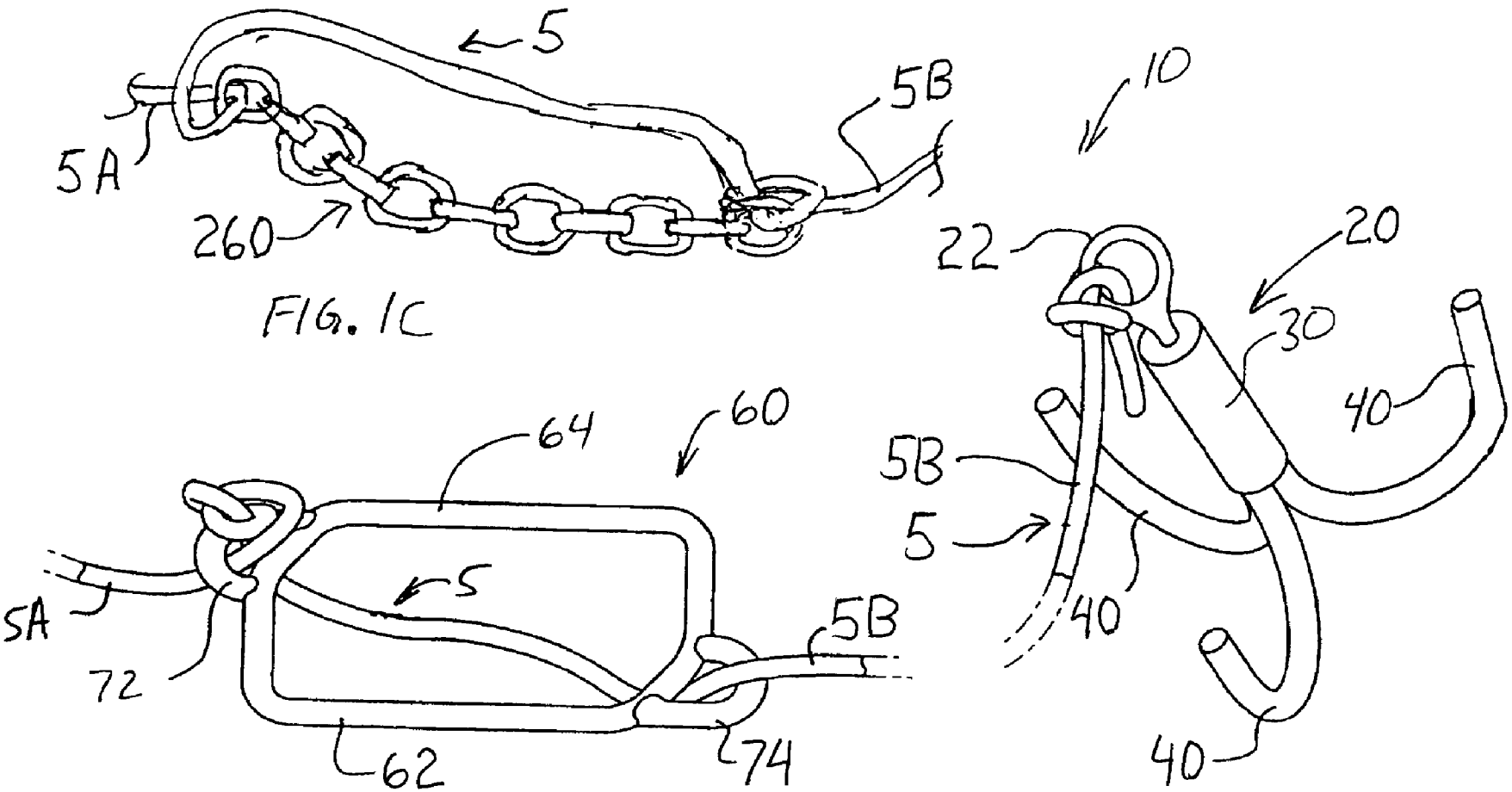
FIG. 1 is an interrupted plan view of the mooring line with a hook and a counterweight.
FIG. 1C is an interrupted plan view of the mooring line with an alternate counterweight.

Referring to the drawings, FIG. 1 provides a plan view of the counter weighted mooring line 10. As can be seen in FIG. 1, counter weighted mooring line 10 includes a line 5, a hook 20 and a counterweight portion 60. As can be seen in FIG. 1, in this example, hook 20 includes an opening 22 at its proximal end for receiving the distal end of line 5, a central hook shaft 30 and three spaced prongs 40 extending away from shaft 30.

Figure 2:
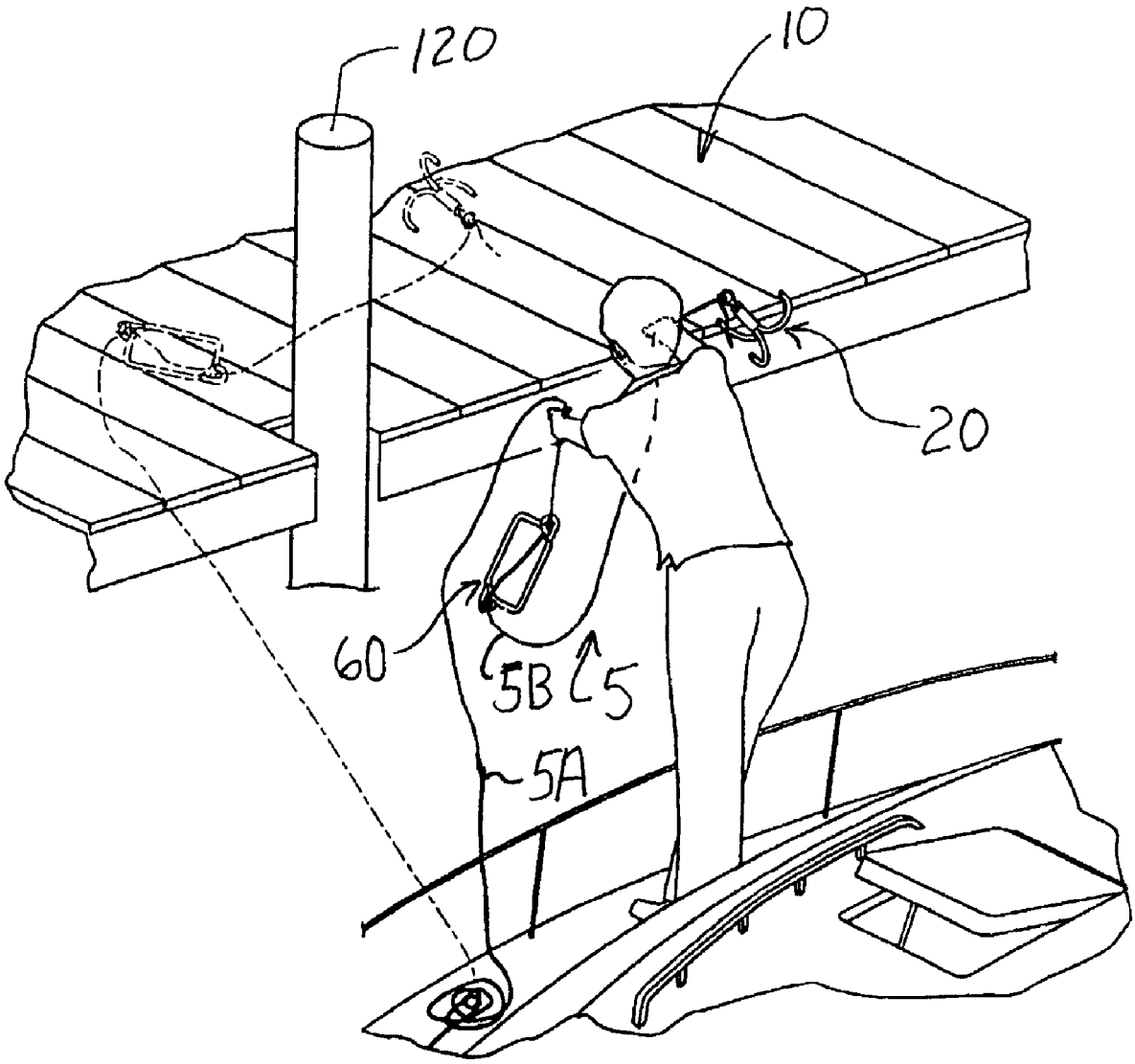
FIG. 2 is a perspective view showing a deckhand tossing a line with a hook and a counterweight portion toward a pole extending from a pier.

As can be seen in FIGS. 1 and 2, line 5 of counterweighted mooring line 10, although preferably a continuous line, may be considered as including a first line portion 5A which extends from the proximal end of line 5 to counterweight 60 and a second line portion 5B which extends from counterweight 60 to hook 20. As can be best seen in FIG. 1, the distal end of first line portion 5A is shown to be secured to counterweight 60 while the distal end of second line portion 5B is shown to be secured to hook 20. This disposes counterweight 60 so that counterweight portion 60 is spaced away from hook 20.

Figure 1A:
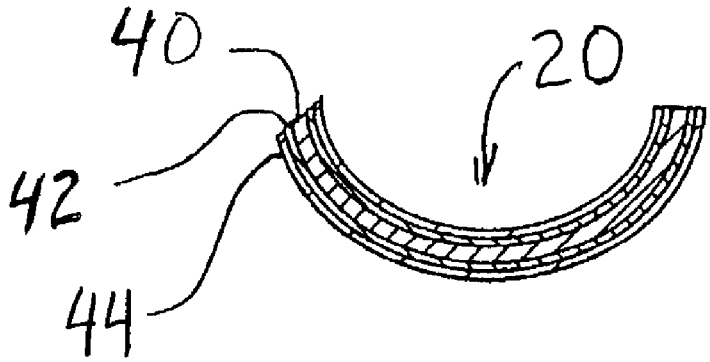
FIG. 1A is a partial sectional view of one prong of the grappling hook.

As is shown in FIG. 1, in this example, hook 20 includes three prongs 40 which, in FIG. 1 are shown to be generally similar in terms of radial spacing and shape. Although hook 20 is shown in FIG. 1 as having three prongs, hook 20 may have one, two or three or more prongs. Prongs 40 preferably extend from hook shaft 30 so that the end of each prong is spaced away from hook shaft 30 and so that the end of each prong is longitudinally spaced from opening 22. As is shown in FIG. 1A, prongs 40 may be covered with an optional first inner layer 42 of dense rubber and an optional second outer layer 44 of foam rubber. Another example approach to adding protective layers to prongs 40 would be to have inner layer 42 as a less dense foam rubber and have outer layer 44 as a dense, protective layer of rubber. Still further, just one layer of dense rubber may be chosen to cover prongs 40 or just one layer of foam rubber may be chosen to cover prongs 40 or some other comparable protective resilient material may be chosen. Optional layers 42 and 44 are intended to prevent damage to float surfaces, poles and watercraft surfaces when hook 20 is tossed to secure the line. Although hook 20 preferably has three prongs as described above, hook 20 may have one or two prongs or more than three prongs.

Figure 1B:
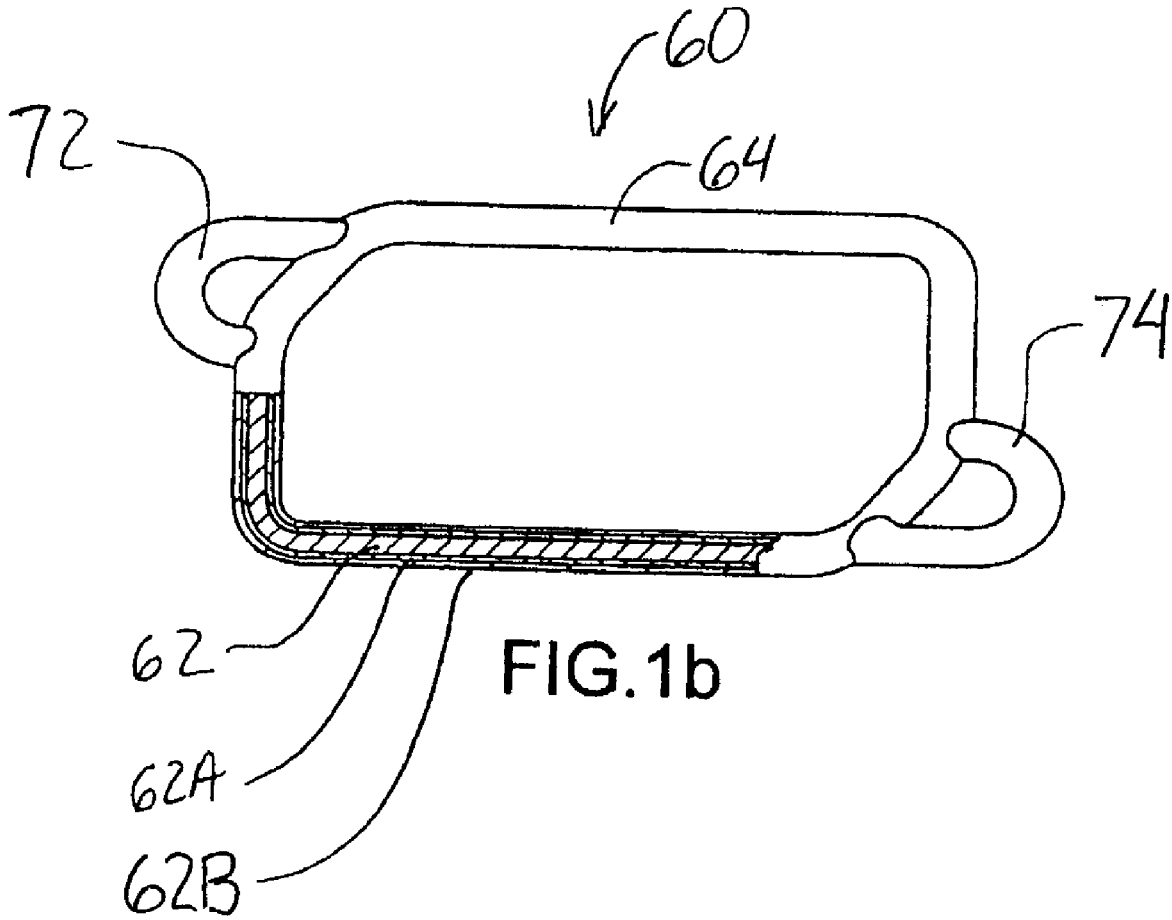
FIG. 1B is a partial sectional view of one leg of the counter weight.

As can also be seen in FIG. 1, counterweight portion 60 includes, in this example, two spaced side rods 62 and 64 which meet at two opposite, spaced openings 72 and 74 which are all welded together to form a single, solid piece. It is preferable that counterweight portion 60 be fashioned from a dense strong material such as steel. As can be seen in FIG. 1B, at least rods 62 and 64 of counterweight portion 60 may optionally be covered with a first inner layer of dense rubber 62A and second outer layer of foam rubber 62B. As noted above for hook 20, optional layers 62A and 62B may be arranged such that the inner layer is fashioned from foam rubber and the outer layer is fashioned from a dense protective coating of rubber. And as noted above for hook 20, other protective resilient materials may be chosen. As was the case with hook 20, optional layers 62A and 62B are intended to prevent damage to float surfaces, poles and watercraft surfaces when hook 20 is tossed to secure the line. FIG. 1 illustrates a preferred counterweight portion 60. The skilled reader should understand counterweight portion 60 may comprise a length of chain as shown with counterweight portion 260 shown in FIG. 1C, a simple bar or section of tubing. Any of these alternative counterweight portion configurations may be effective for providing a counterweight portion which is spaced away from hook 20. Any such alternate counterweight portions may also be coated with protective rubber. Accordingly, each chain link of counterweight portion 260 may be separately coated with rubber.

FIG. 2 shows a first mode of using counterweighted mooring line 10. As is illustrated in FIG. 2, a deckhand (or a watercraft pilot) is standing on the deck of a boat 110 and is tossing counterweighted mooring line 10 toward a pole 120 associated with a pier. The method used by the deckhand is to hold second line portion 5B between hook 20 and counterweight portion 60 in opposite hands so that hook 20 is opposite the proximal end of line 5 which is tied to the watercraft. The deckhand holds second line portion 5B so that hook 20 dangles from one hand and counterweight portion 60 dangles from the opposite hand. In FIG. 2, the deckhand holds the line so that his left hand grasps the line proximal to counterweight portion 60 and his right hand grasps the line proximal to hook 20. The deckhand then swings hook 20 and counterweight portion 60 from opposite hands preferably in unison and then releases hook 20 and counterweight portion 60 generally simultaneously and preferably so that second line portion 5B is thrown toward pole 120 so that second line portion 5B makes contact with pole 120. Because hook 20 is counterweighted by counterweight portion 60, hook 20 and counterweight portion 60, if thrown properly, generally translate toward pole 120 in unison along generally parallel paths. Thus when line 5 encounters pole 120, hook 20 and counterweight portion 60 arc around pole 120 in generally opposite directions and cause line 5 to wrap around pole 120.

Figure 2A:
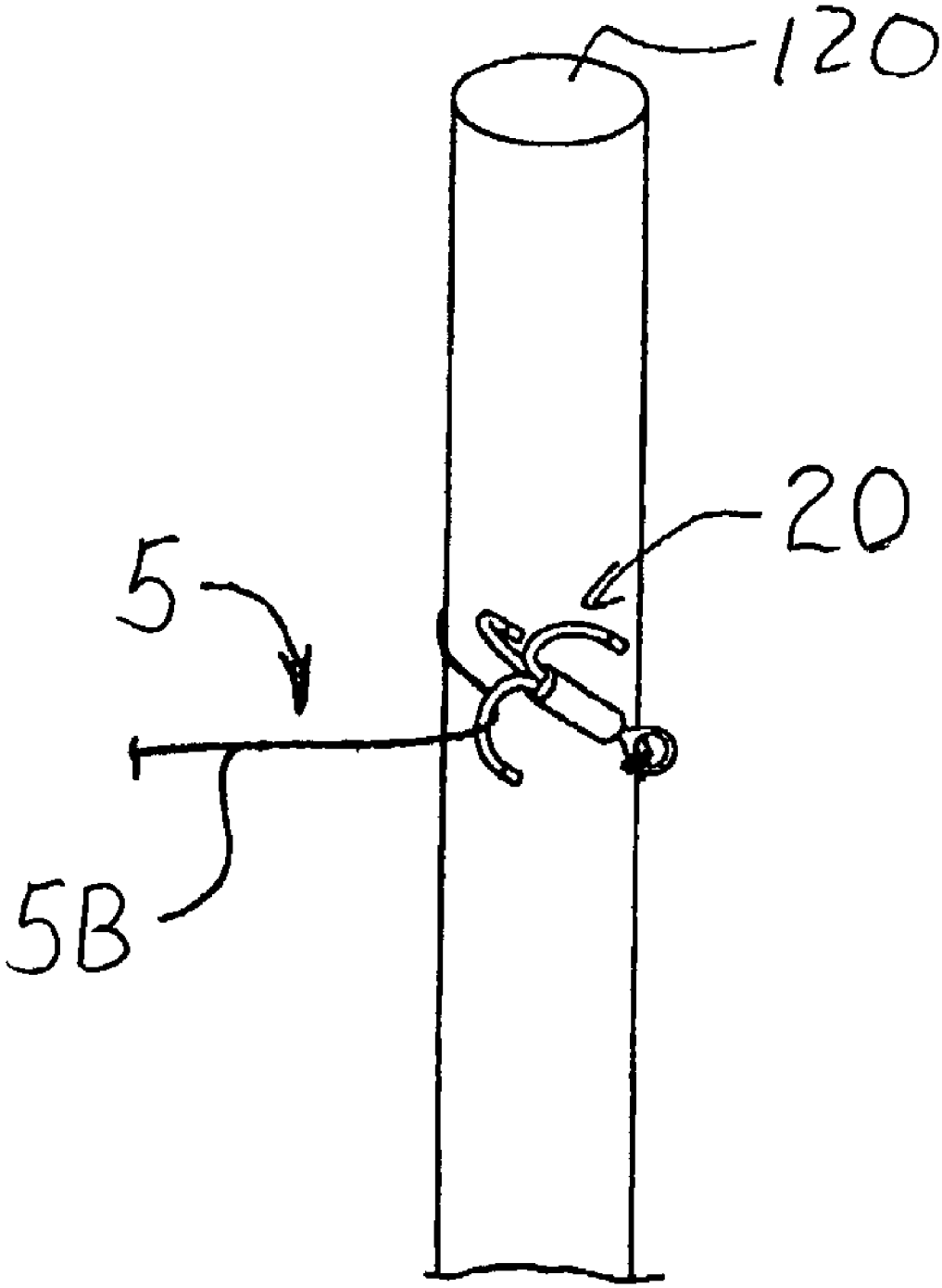
FIG. 2A is a perspective view showing a hook engaging a line to secure a line around a post.

The usual result of the above described method, as is illustrated in FIG. 2A, is that hook 20 will catch either counterweight portion 60 or as shown in FIG. 2A some portion of line 5 thereby establishing a loop around pole 120 which is sufficiently stable for the deckhand to pull the watercraft toward pole 120 in order to establish a more secure mooring of that line. In FIG. 2A, hook 20 is shown engaged with line 5 which is wrapped around pole 120. To accomplish this result, it is preferable that the distance between hook 20 and counterweight portion 60 be about 2 or 3 times the circumference of the targeted post. These steps can be accomplished without the assistance from a person on the pier or float. This capability greatly facilitates the mooring of watercraft. This is especially the case in difficult conditions such as high winds or in the presence of high waves. The skilled reader should note the deckhand did not need to step onto float 4 in the absence of on-shore assistance but could secure line 5 by throwing counterweighted mooring line 5 at pole 120 as described above. This greatly improves the process of mooring watercraft.

Figure 3:
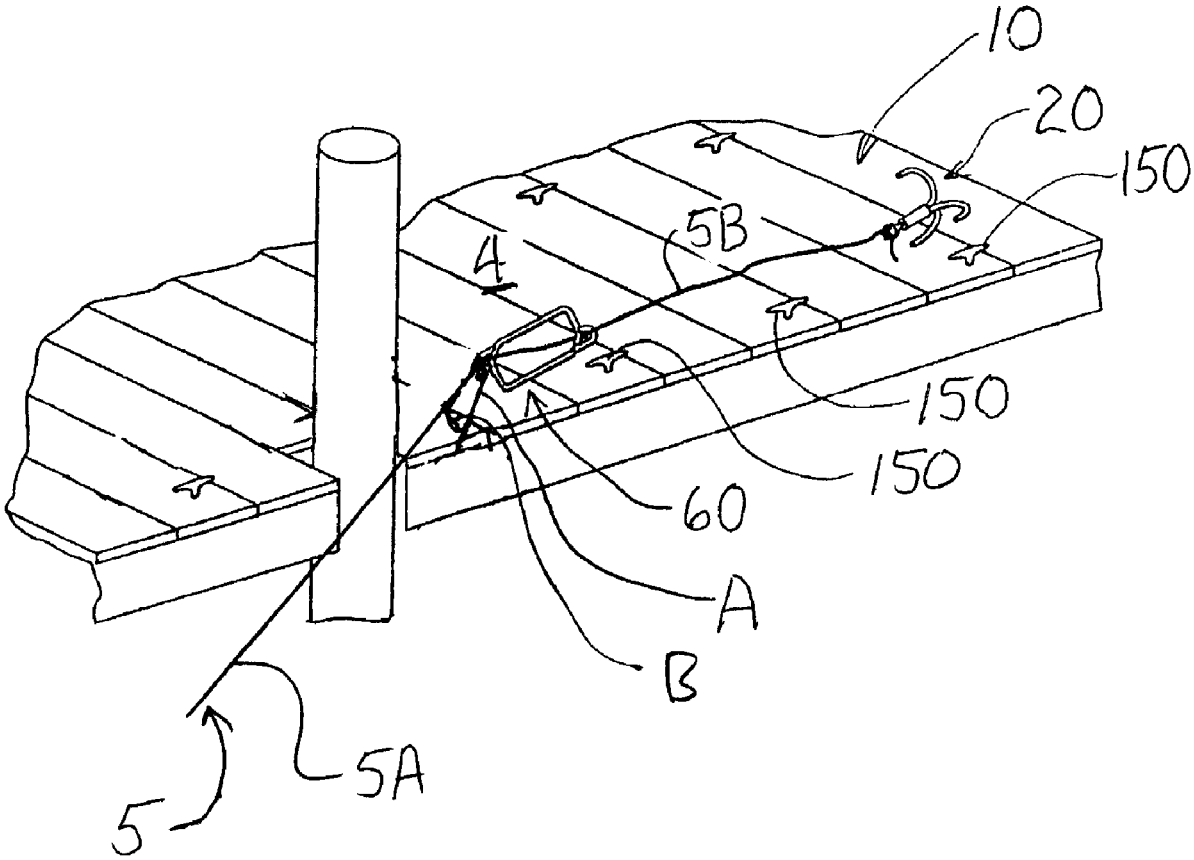
FIG. 3 shows a line with a hook and a counterweight portion being pulled across a float with cleats.

FIG. 3 illustrates a second mode of using counterweighted mooring line 10. As is illustrated in FIG. 3, counterweighted mooring line 10 is being dragged across a float 4 having cleats 150 secured about its perimeter. As shown in FIG. 3, as mooring line 5 is pulled from its proximal end by a deckhand (not shown) mooring line 5 forms an angle B with the surface of float 4. In FIG. 3, line A should be understood as the vertical projection of mooring line 5 on to the surface of float 4. As can be seen in FIG. 3, counterweight portion 60 weigh line 5 down so that second line portion 5B between counterweight portion 60 and hook 20 is in contact with the surface of float 4. This is an important distinction between counterweighted mooring line 10 and a typical mooring line. Counterweight portion 60, hook 20 and second line portion 5B between counterweight portion 60 and hook 20 are all in contact with float 4 as they are dragged across float 4 and thus present a long section of equipment for catching a cleat. This greatly increases the likelihood that some portion of counterweight portion 60, hook 20 or second line portion 5B extending between them will catch at least one of cleats 150 thus allowing the deckhand to pull the watercraft in for a more secure mooring. A single hook or even a hook having two or more prongs at the end of line 5 would not function this way because the line would be more likely to angle up off the deck at the hook end of the line as it is pulled by the deckhand thus presenting a much smaller footprint for catching a cleat. This is an important distinction in adverse conditions where the watercraft may be pitching and rolling or when no on-shore assistance is available. Counterweighted mooring line 10 may be thrown across a float 4 having cleats 150 by an action similar to that described above for engaging a pole or may be thrown by swinging counterweight portion 60 and hook 20 from one hand. In any case, the object is to throw the line across the surface of float 4 and drag in the line until some portion of line 5 in contact with float surface 4 catches one of cleats 150.

Those skilled in the navigation of watercraft appreciate the initial importance of getting a line to shore in a rapid and safe manner in order to get the docking boat under control so that more permanent attachments can be made in a controlled situation. The size and strength of a mooring line as well as the size and scale of counterweight portion 60 and hook 20 may vary depending on the size of the watercraft. Skilled pilots of watercraft will readily appreciate the advantages of counterweighted mooring line 10 as described above. Counterweighted mooring line 10 will allow a pilot or deckhand to rapidly engage a pole or cleat without on-shore assistance. The ease of doing so and the ability to do so without on-shore assistance and the attending increase in the speed of doing so may greatly reduce the risk of a mishap or damage to a watercraft in adverse, high wind or high seas conditions. Fast and easy mooring will reduce the likelihood for mishaps in adverse conditions. Thus, the above described objectives have been met by providing a counterweighted mooring line which may be employed to quickly and rapidly secure a watercraft without assistance.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A counterweighted mooring line system, for mooring a watercraft to a pole associated with a float for mooring a watercraft, comprising:

a line having a proximal end suitable for securing to a watercraft and an opposite distal end, a hook attached to the distal end of the line, the hook including a center shaft having a proximal end and a distal end and at least one prong extending from the distal end of the center shaft, the at least one prong having a distal end and the distal end of the at least one prong being spaced away from the center shaft, the hook also having an opening at the proximate end of the center shaft for securing a line, a counterweight secured to the line, the counterweight spaced away from the hook toward the proximal end of the line, the counterweight including at least two spaced rods that are connected together at their respective opposite ends, the counterweight further including at least one eyelet through which the line passes, the counterweight spaced sufficiently from the hook so that the line between the counterweight and the hook is operable for grasping by two spaced apart hands, whereby the counterweight and the hook are operable to be tossed such that the hook, the counterweight and the line between the hook and the counterweight translate through the air with the counterweight and the hook generally spaced apart and side by side for subsequent wrapping of the line around the pole associated with the float and subsequent hooking of the line by the hook thereby securing the mooring line to the pole.

2. The counterweighted mooring line of claim 1, wherein; the hook includes at least two prongs.

3. The counterweighted mooring line of claim 1, wherein; the hook includes at least two prongs each having an end which is longitudinally spaced away from the opening at the proximate end of the shaft.

4. The counterweighted mooring line of claim 1, wherein; the hook includes at least two prongs and the hook is covered with a layer of rubber.

5. The counterweighted mooring line of claim 1, wherein; the hook includes at least three prongs and the hook is covered with first inner layer of rubber and a second outer layer of rubber which has a lower density than the first layer of rubber.

6. The counterweighted mooring line of claim 1, wherein; the counterweight includes at least two spaced rods that are connected together at two opposite spaced openings.

7. The counterweighted mooring line of claim 1, wherein; the counterweight is a length of chain presenting two opposite spaced openings at each end thereof.

8. The counterweighted mooring line of claim 1, wherein; the counterweight is a length of chain presenting two opposite spaced openings at each end thereof and the chain links are coated with a resilient protective material.

9. The counterweighted mooring line of claim 1, wherein; the counterweight includes at least two spaced rods which are connected together at two opposite spaced openings and the counterweight is covered with a layer of protective resilient material.

10. The counterweighted mooring line of claim 1, wherein; the counterweight includes at least two spaced rods which are connected together at two opposite spaced openings and the counterweight is covered with a layer of dense rubber and a second outer layer of foam rubber.

11. The counterweighted mooring line of claim 1, wherein; the hook includes at least three prongs extending away from the shaft of the hook and the counterweight includes at least two spaced rods which meet at two opposite spaced openings.

12. The counterweighted mooring line of claim 1, wherein; the hook includes at least three prongs extending away from the shaft of the hook, the counterweight includes at least two spaced rods which are connected together at two opposite spaced openings, and, and the hook and the counterweight are covered by a layer of rubber.

13. A method for mooring a watercraft to an upright pole comprising the following steps:

(a) obtaining a counterweighted mooring line including a line having a proximal end secured to the watercraft, an opposite distal end, a hook secured to the distal end of the line and a counterweight attached to the line which is spaced away from the hook, (b) grasping the line with a first hand at a point between the proximal end of the line and the counterweight so that the counterweight hangs down from the first hand, (c) grasping the line with a second hand at a point between the counterweight and the hook so that the hook hangs down from the second hand, (d) swinging the counterweight and the hook generally in unison with both hands and then releasing the line generally simultaneously with both hands so that the counter weight and the hook pass through the air in a generally spaced apart side by side fashion until the line between the counterweight and the hook makes contact with the upright pole, whereby at least one of the hook and the counterweight proceeds around the pole so that the hook hooks at least one of the line or the counterweight thereby securing the line to the pole.

* * * * *